United States Patent [19]

Aikins

[11] 4,053,118

[45] Oct. 11, 1977

[54] REVERSIBLE REEL UNIT

[75] Inventor: Warren A. Aikins, Longview, Wash.

[73] Assignee: Swing-Shift Mfg. Co., Rainier, Oreg.

[21] Appl. No.: 688,782

[22] Filed: May 21, 1976

[51] Int. Cl.[2] ..... B65H 75/38; B65H 75/48

[52] U.S. Cl. ..... 242/107.11; 191/12.2 R; 242/86.1

[58] Field of Search ..... 242/107.1-107.15, 242/107, 100.1, 86.1; 191/12.2 R, 12.4

[56] References Cited

U.S. PATENT DOCUMENTS

| | | | |
|---|---|---|---|
| 1,276,825 | 8/1918 | Swope | 242/107.1 |
| 1,446,410 | 2/1923 | Bennett et al. | 242/107.1 |
| 2,438,515 | 3/1948 | Mohler | 242/107.1 X |
| 3,284,023 | 11/1966 | Sowell | 242/125.1 |
| 3,346,705 | 10/1967 | Slinkard et al. | 242/107 X |
| 3,474,985 | 10/1969 | Brudi et al. | 242/107.11 |
| 3,695,544 | 10/1972 | Morey | 242/107 |

FOREIGN PATENT DOCUMENTS

| | | | |
|---|---|---|---|
| 478,803 | 1/1938 | United Kingdom | 242/107.1 |

*Primary Examiner*—Stanley N. Gilreath
*Assistant Examiner*—John M. Jillions
*Attorney, Agent, or Firm*—Lee R. Schermerhorn

[57] ABSTRACT

The reel winds in hose or electric cable lines without troublesome rotating connections for the fluid or electric circuits involved. As line is unwound from the reel, another section of the line is first unwound from a small hub extension adjacent the reel and then rewound in an opposite direction so that this internal section of the line which is contained within the reel housing requires storage space for less than one-third as much line as the external length which is reeled out and in. An actuating spring is externally mounted for easy replacement or repair. The spring and internal section of the line are readily reversible to provide a reversible reel for either left hand or right hand mounting on the equipment where it is used, such as a lift truck.

11 Claims, 11 Drawing Figures

11
12
12a
13
13a
10
15
16
17
18
33
35
60
63, 64
20
21
22
23
24
25
26
30
31
32
34
36
37
40
41
42
43
44
45
50
51
55
56
57
61
62
72
75
76
4

17
32
33
20
21
30
55
34
60
62
63
64
15

17
59
30
58
21
31
71
57
56
70
30
65
60
72
32

12a
13

12a

12a 17a
12
21
55
30
17
60
15
13
18
12
60
30
17
15
13
17
12
13
30
60
15
17
12
30
60
15

25
50
26
32
33a
17
20a
82
36
36
34
37
17
40
83
35
85
14
22
23
43
21
44
24
80
81
84
88
17
93
61
92
17

10
17
32
33a
50
20a
88
17
83
90
86
90
82
21
85
87
83
90
90
17
50
32
32
93
92
92
20a
61
10

REVERSIBLE REEL UNIT

BACKGROUND OF THE INVENTION

This invention relates to a reel for winding in hose or electric cable lines without rotating connections for the fluid or electric circuits involved.

In the adaption of hydraulically actuated attachments on fork lift trucks, for example, it is often necessary to use some sort of hydraulic hose take up device to accommodate the movements of the fork carriage. Generally, this is accomplished with a standard hydraulic hose reel which is composed of a reel with an internal clock type spring for the winding action. The hoses are connected to the reel through the hub with hydraulic rotary fittings. Such rotary fittings are a constant maintenance problem because of leakage. Also, the conventional reel unit has to be completely disassembled if a breakage should occur in the spring.

Reels without rotary connections heretofore proposed have been too complicated and expensive for the present purpose. There is a need for a more practical form of construction.

Objects of the invention are therefore to provide an improved reel for hose or electric cable lines without rotating connections, to provide a reel of the type described of more practical and economical construction, to provide an actuating spring for such a reel which is externally mounted for easy replacement or repair and to provide a reversible reel which is adapted for either left hand or right hand mounting on equipment where it is used.

SUMMARY OF THE INVENTION

As line is unwound from the present reel, another section of the line is first unwound from a small hub extension adjacent the reel and then rewound in an opposite direction so that this section of the line which is contained within the reel housing requires storage space for less than one-third as much line as the length which is reeled out and in. The ends of this rewind or counterwind section of the line may be secured in the device and equipped with connector fittings for attachment to two external sections whereby any one of the three line sections may be replaced independently of the other two sections.

The actuating spring for the reel is externally mounted for easy replacement or repair and both the spring and internal section of the line are readily reversible to provide a reversible reel.

The invention will be better understood and additional objects and advantages will become apparent from the following description of the preferred embodiments illustrated in the accompanying drawings. Various changes may be made, however, in the details of construction and arrangement of parts and certain features may be used without others. All such modifications within the scope of the appended claims are included in the invention.

DESCRIPTION OF THE PREFERRED EMBODIMENTS

Figures 1, 2, 3:
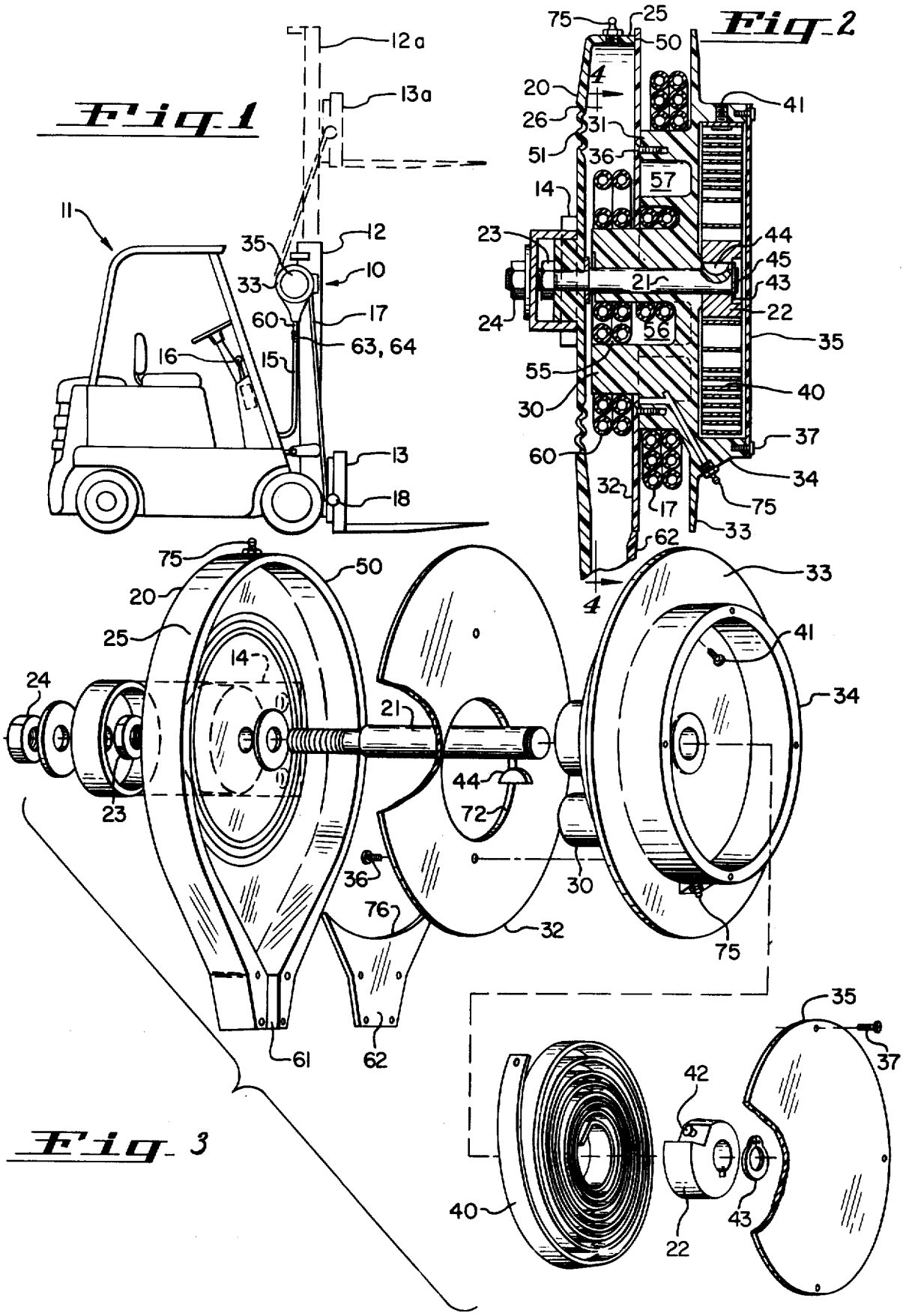
FIG. 1 is a side elevation view of a lift truck having a hose reel embodying the invention.
FIG. 2 is a sectional view of the reel unit.
FIG. 3 is an exploded view of the reel unit.

The present reel unit 10 is illustrated by way of example on a common type of industrial lift truck 11 in FIG. 1. The lift truck has a telescopically extensible mast 12 which may be raised as indicated in broken lines at 12*a*. A load carriage 13 may be raised and lowered on the mast 12 and on the mast extension 12*a* as indicated in broken lines at 13*a*. Thus, the load carriage moves down below the level of the reel unit and up above the reel unit.

It is common practice to equip such a load carriage with hydraulic devices (not shown) for rotating the load, for clamping the load or for other purposes. Such hydraulic devices require flexible hose connections with a hydraulic pump and control valves on the truck. The purpose of the reel unit 10 is to take up slack in the hose lines, and pay out the hose lines, as carriage 13 moves up and down on mast 12 and mast extension 12*a*, toward and away from the reel unit.

In the present illustration, the reel unit 10 is mounted in fixed position near the top of mast 12 by means of the mounting bracket 14 in FIG. 2. A twin hose line 15 of fixed length extends between the reel unit 10 and a control valve unit 16 on the truck. A twin hose line 17 is extendable and retractible from reel unit 10 to hydraulic connector or hose clamp fittings 18 on carriage 13. Reel unit 10 is equipped with a spring to wind in slack and keep hose line section 17 taut at all times as carriage 13 moves toward and away from the reel unit, so that the hose line section 17 does not hang loose or slack at any time.

Reel unit 10 is not limited to lift trucks or hydraulic systems. It is equally useful to handle the supply wires for electrical equipment. For such purposes, the lines 15 and 17 may represent multiconductor cables for electrical equipment, as for example electric actuators for rotating or clamping a load on an electric lift truck, or other electrical equipment.

As shown in FIGS. 2 and 3, reel unit 10 has certain stationary parts and certain rotating parts. The stationary parts comprise a housing 20 fixed to mounting bracket 14, a shaft 21 fixed at one end to housing 20 and a spring member hub 22 fixedly mounted on the other end of shaft 21. Shaft 21 is secured to housing 20 by a nut 23 on the shaft and is secured to mounting bracket 14 by a nut 24 on the shaft. Housing 20 has a marginal side wall flange 25 enclosing an uncoiling chamber 26. Housing 20 may be molded from a suitable plastic material such as polyurethane.

Rotating as a unit on shaft 21 are a small counter wind hub 30, a large reel hub 31, reel flange discs 32 and 33, spring housing 34 and spring cover plate 35. All of these parts are made as a single integral piece, except reel flange disc 32 which is secured to hub 31 by screws 36, and cover plate 35 which is secured to spring housing 34 by screws 37. Parts 30, 31, 33 and 34 may be molded from polyurethane and reel flange disc 32 may be cut from a sheet of polypropylene. This provides an economical construction.

A coiled power spring 40 has an outer end detachably secured to spring housing 34 by an anchor screw or pin 41. Spring housing 34 is formed as an axial circular flange on reel disc 33. The inner end of the spring is detachably secured to spring anchor hub 22 by a fixed pin 42. Hub 22 is secured to stationary shaft 21 by snap ring 43 and key 44. Axial adjustment is provided by shims behind the snap ring at 45.

The marginal flange 25 on stationary housing 20 has a lip 50 in sliding, sealing engagement with the outer face of rotating reel flange disc 32. The pressure between these parts is adjusted by adding or removing shims 45. In order to minimize the sliding friction, housing 20 is made flexible by a ring of thin walled corrugations 51 concentric with shaft 21.

Figures 4, 5, 6, 7, 8, 9:
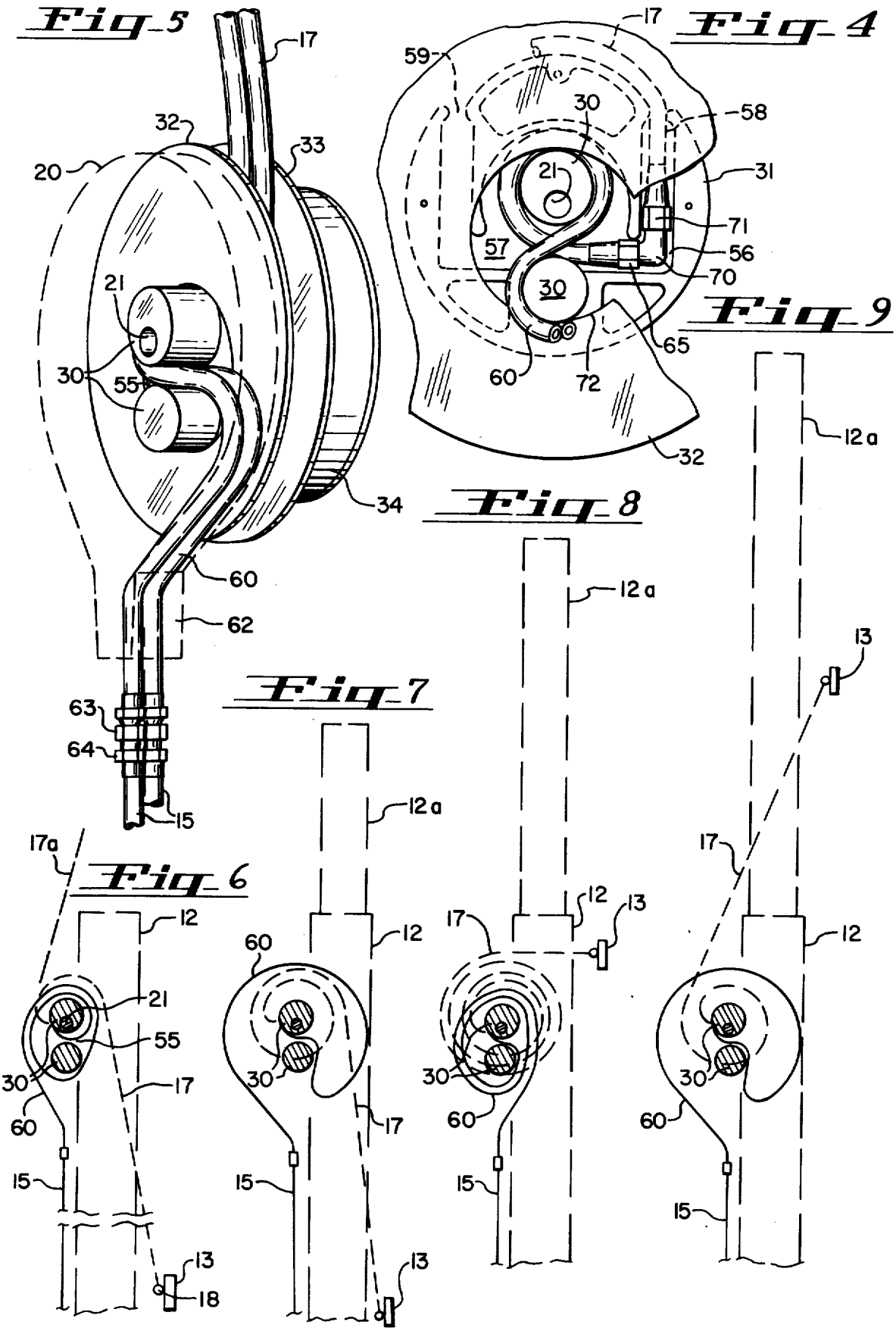
FIG. 4 is a view approximately on the line 4—4 in FIG. 2.
FIG. 5 is an isometric view of the assembled reel with parts in phantom.
FIG. 6 is a diagramatic view showing the reel line fully extended, both upward and downward.
FIG. 7 is a similar view showing the reel line half extended in downward direction.
FIG. 8 is a similar view showing the reel line fully retracted.
FIG. 9 is a similar view showing the reel line half extended in an upward direction.

Counterwind hub 30, which is an extension of the larger hub 31, is provided with a transverse groove or passageway 55 for an internal portion of the hose or cable line. Groove 55 communicates with a pair of L shaped grooves or passageways 56 and 57 in reel hub 31 as shown in FIG. 4. Grooves 56 and 57 have outer ends at 58 and 59 opening through the winding surface of reel hub 31. Groove 56, 58 leads the hose line 17 for wrapping in a counterclockwise direction on hub 31 and groove 57, 59 leads the hose line for wrapping in a clockwise direction as viewed in FIG. 4.

The hose line 17 is shown in groove 58 for counterclockwise wrapping. By reversing the direction of the line through groove 55 and then leading the line through groove portions 57, 59, the hose line may be reversed for clockwise wrapping. In such case, spring 40 is also reversed in spring housing 34. Thus, the reel unit 10 is adapted for mounting on the left side of mast 12, as well as the right hand mounting shown in FIG. 1.

In addition to the previously mentioned external twin hose lines 15 and 17, the reel unit contains a third twin hose line section 60. Hose line section 60 is an internal line with an external end portion clamped in a groove 61 in stationary housing 20 by a clamp plate 62 shown in FIG. 3. Clamp plate 62 fixedly secures this portion of the hose line against movement. As shown in FIG. 5, the emergent ends of the hoses in hose line section 60 are equipped with connector fittings 63 for connection with connector fittings 64 on the line 15.

The inner ends of the two hoses in hose line section 60 are equipped with connector fittings 65 for connection with a pair of elbow fittings 70 in the right angle groove portion 56 in FIG. 4. The twin hoses in hose line 17 have similar connector fittings 71 connected with the two elbow fittings 70. Thus, the elbow fittings 70 anchor the inner end of hose line section 60, as well as the inner end of hose line 17 in the reel hub 31.

When line 17 is arranged for clockwise wrapping on reel hub 31, the elbow fittings 70 are placed in groove 57, instead of groove 56. In either case, the elbow fittings are retained in the selected groove by the removable reel flange disc 32. Disc 32 is of annular configuration having an inner edge 72 which surrounds the hub extension 30 as shown in FIG. 2 and provides a central opening in the disc so that line section 60 may pass through the disc.

If one of the three line sections 15, 60 or 17 is damaged in use, it is not necessary to replace the other two sections, thereby providing economical maintenance. The shorter the hoses in section 60, the less uncoiling space is required in chamber 26 as will become apparent in the following description of the operation. This allows stationary housing 20 to have a diameter no larger than the reel flange discs 32 and 33, which provides a compact unit.

In FIG. 6, carriage 13 is in its lowest position and almost all of external line section 17 is unwound from reel hub 31 which is omitted in these views for clarity. Substantially all of internal line section 60 is wound in counterclockwise wrap on hub 30. Line section 17 is shown in broken lines to distinguish it from line section 60.

In FIG. 7, carriage 13 has moved upward approaching the reel unit and in this upward movement spring 40 has rotated the reel counterclockwise to take up slack in line section 17 and wind it on hub 31. FIG. 7 shows carriage 13 midway between its lowest position and the level of the reel unit with approximately half of line section 17 wound on reel hub 31. At this point, line section 60 is completely unwound from hub 30 and is disposed in a loop in chamber 26 against the inner periphery of stationary housing 20.

In FIG. 8, carriage 13 has risen to the level of the reel unit and spring 40 has wound all of line 17 on hub 31. The continued counterclockwise rotation of the reel has now rewound all of line section 60 on hub 30 in clockwise wrap, which is the reverse of the winding direction in FIG. 6.

In FIG. 9, carriage 13 has risen to a point midway between the level of the reel unit and the top position of the carriage, reversing the rotation of the reel. Half of line 17 has been unwound from hub 31, tightening the spring 40 and unwinding all of line section 60 from hub 30, allowing this line section to again form a large loop against the inner periphery of stationary housing 20.

When carriage 13 reaches top position, substantially all of line 17 is unwound and the continued rotation of the reel in clockwise direction has reversed the wrap of line section 60 to counterclockwise with all of this line section now wound on hub 30. This puts the parts back in FIG. 6 positions, except that line 17 now extends upward as indicated as 17*a*.

In order to produce the described mode of operation, the twin hose sections 17 and 60 are each preferably formed as two hoses connected together side by side so that they will not separate from each other. To facilitate the rapid wrapping, unwrapping and reverse wrapping of hose section 60 in chamber 26, an ample supply of a silicone type lubricant is provided through lubrication fittings 75. Sealing lip 50 retains the lubricant and excludes foreign matter. On the under side of housing 20, the clamp plate 62 has an arcuate edge 76 which approaches the edge of disc 32 as closely as possible without touching the disc, to minimize any gap at this point.

MODIFICATION IN FIGS. 10 AND 11

Figure 10:
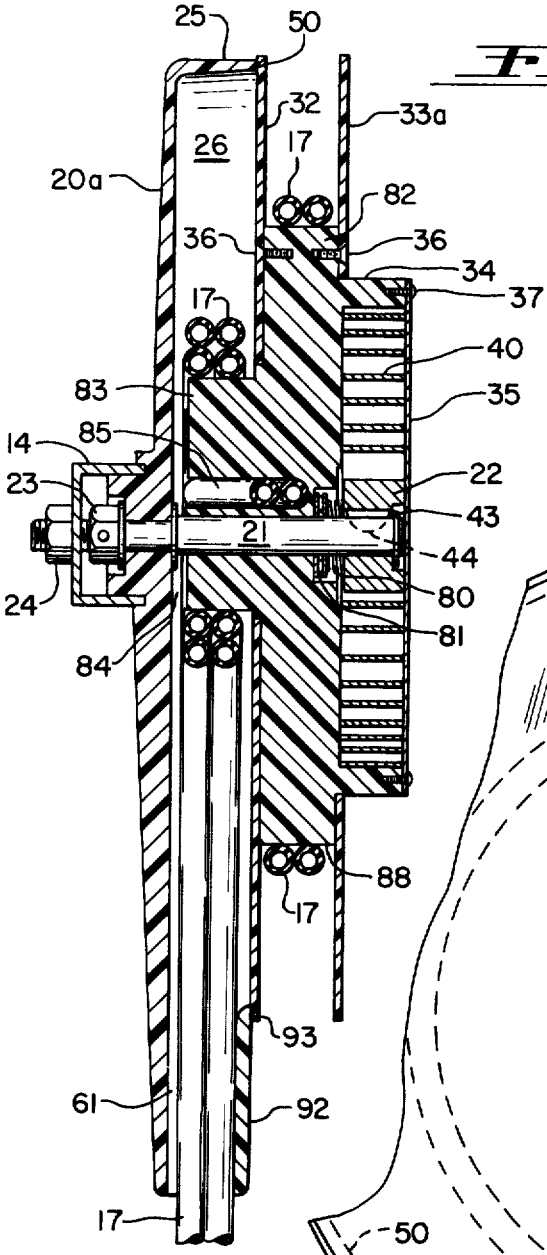
FIG. 10 is a view on the line 10—10 in FIG. 11 showing a modification.
Figure 11:
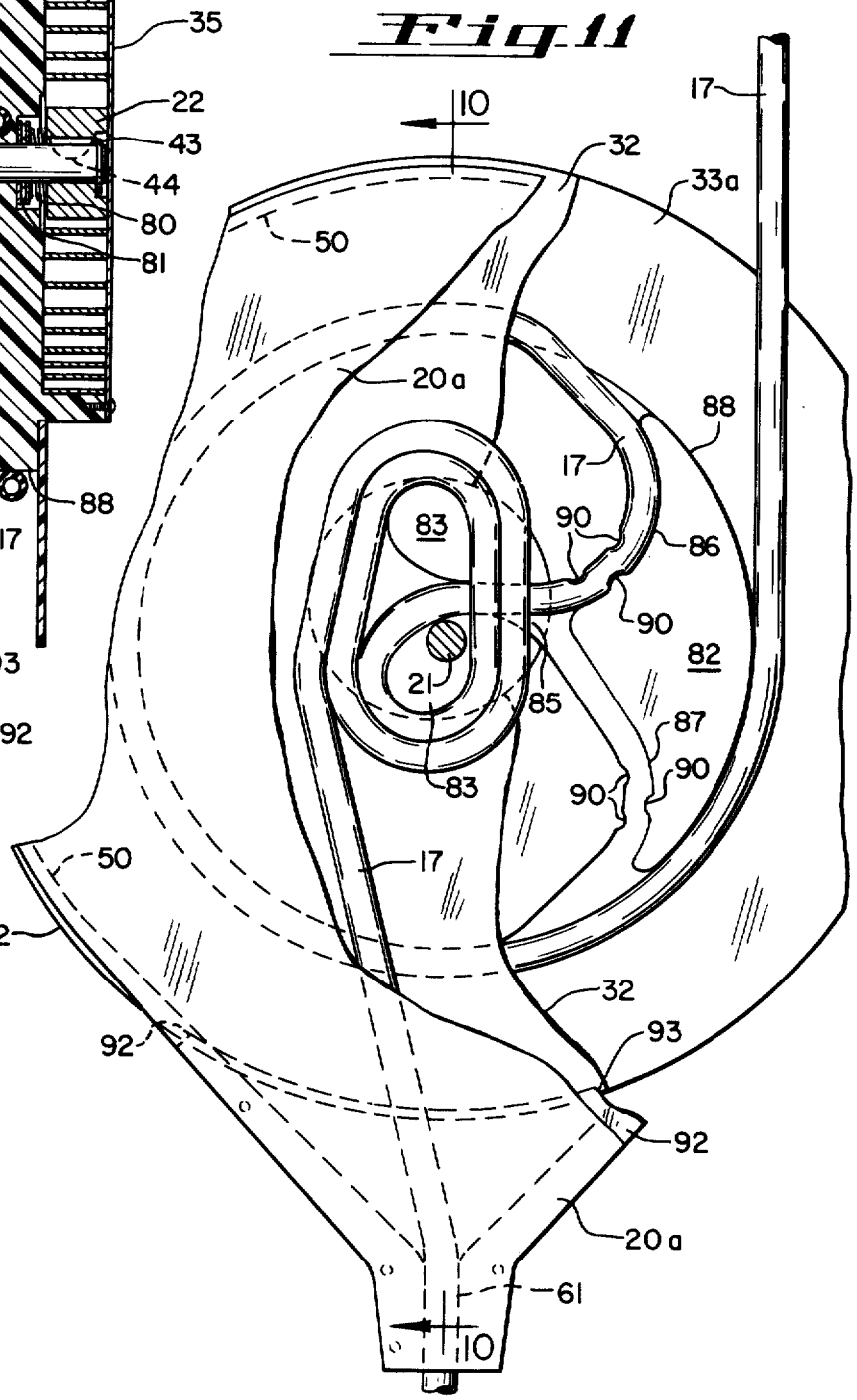
FIG. 11 is an elevation view with parts broken away, showing the modification.

The modification in FIGS. 10 and 11 differs from the first embodiment essentially in that different spring means are provided for holding reel flange disc 32 against the sealing lip 50 of stationary housing 20*a* and separate hose sections 15 and 60 are omitted, whereby the external hose line 17 extends through the reel unit to control valve 16.

In large units, the front reel flange disc 33a may be made as a separate piece as shown in FIG. 10 while in smaller units this part may be integral with the hub as shown at 33 in FIG. 2.

In FIG. 10, stationary housing 20a may be a rigid member. In this case, back reel flange disc 32 is held against sealing lip 50 by a compression spring 80 which may be a metal coil spring as shown or a thick washer of resilient plastic material. One end of spring 80 seats against stationary spring anchor hub 22 and the opposite end seats against a thrust washer 81 which bears against hub 82. Thrust washer 81 comprises a ring of radial roller bearings disposed between two flat washers. There is sufficient clearance at 84 between hub extension 83 and housing 20a to permit axial movement of hub 82 on shaft 21 so that spring 80 holds flange disc 32 in sealing engagement with lip 50. Housing 20a is provided with lubrication fittings 75 (not shown) as in FIG. 2.

Hub extension 83 is divided into two parts by a transverse groove 85 which communicates with two oppositely curved grooves 86 and 87 in reel hub 82. Hose line 17 is disposed in groove 86 in a right hand reel and may be shifted to groove 87 for a left hand reel. Grooves 86 and 87 emerge tangentially in opposite directions through the winding surface 88 of the reel hub 82. A series of staggered projections 90 in opposite sides of grooves 86 and 87 deflect and anchor the hose line 17 at these points within the hub. When hose line 17 is shifted to groove 87, the spring 40 is removed and turned over to reverse its action as described in connection with the first embodiment.

Clamp plate 92 anchors the emergent portion of hose line 17. Clamp plate 92 has an arcuate upper edge at 93 which forms a sealing lip in the plane of sealing lip 50 to provide a sliding seal against flange disc 32 in the region of hose groove 61. Thus, the two lips 50 and 93 provide a full 360° seal to retain lubricant in housing 20a and exclude dirt.

In other respects, the construction of the modification in FIGS. 10 and 11 is the same as in the first embodiment and the operation is the same, as described in connection with FIGS. 6 to 9.

When there are a number of hydraulic actuators to shift the load or perform other functions on carriage 13, it may be desired to provide solenoid valves on the carriage to control such movements or functions by means of manual switches in the truck 11. In such case, both right and left hand reel units are advantageous, one on each side of mast 12, one reel carrying the hydraulic twin hose line 17 to supply the actuators and the other reel carrying a multiple conductor electric cable to energize the solenoid valves.

What is claimed is

1. A reel unit for a flexible line such as a hose line or electric cord line, comprising a stationary housing having a closed side and an open side, a stationary shaft mounted at one end in said closed side of said housing and having an opposite end extending out of said open side, and a rotary member mounted for rotation on said shaft; said rotary member comprising a reel having a reel hub outside of said housing, a first radial reel flange on said hub adjacent said open side of said housing, and a second radial reel flange on said hub spaced away from said housing; an axial circular flange outstanding from the outside surface of said second reel flange, said second reel flange and axial circular flange defining a spring housing, a flat spiral power spring in said spring housing having an inner end connected to said shaft and an outer end connected to said spring housing; a counterwind hub extension on said reel hub extending into said stationary housing, and grooves in said hub and hub extension for leading said line from said hub extension to a winding surface on said hub; said stationary housing having a peripheral sealing lip in sliding engagement with said first radial reel flange to provide a sealed counterwind chamber for said line in said housing.

2. A reel unit as defined in claim 1, said grooves in said hub comprising a first groove for leading said line in a direction for clockwise coiling on said winding surface and a second groove for leading said line in a direction for counterclockwise coiling on said winding surface.

3. A reel unit as defined in claim 1, said hub, hub extension, second radial reel flange and axial circular flange comprising integral parts of a one piece element in said rotary member.

4. A reel unit as defined in claim 1, including resilient means to apply sealing pressure between said lip and said reel flange.

5. A reel unit as defined in claim 4, said resilient means comprising a ring of corrugations in said closed side of said housing concentric with said shaft to make said housing flexible so as to press said lip against said reel flange.

6. A reel unit as defined in claim 4, said resilient means comprising an axial thrust member on said shaft acting on said reel.

7. A reel unit as defined in claim 1, including lubrication fittings on said stationary housing and rotary member for admitting lubricant to said line in said grooves and counterwind chamber.

8. A reel unit as defined in claim 1, including means to anchor said line at an entrance to said stationary housing, and means to anchor said line in said reel hub.

9. A reel unit as defined in claim 8, said last anchor means comprising projections in said grooves in said reel hub arranged to deflect and grip said line.

10. A reel unit as defined in claim 8, said last anchor means comprising a right angle bend in said groove in said reel hub.

11. A reel unit as defined in claim 9, said last anchor means including an elbow fitting in said right angle bend in said groove connecting an internal portion of said line in said reel hub and stationary housing with an external portion of said line on said reel.

* * * * *